United States Patent [19]

Leavens

[11] Patent Number: 4,965,980

[45] Date of Patent: Oct. 30, 1990

[54] DECK BRACKET

[76] Inventor: Weston Leavens, 4972 Coronado Ave., San Diego, Calif. 92107

[21] Appl. No.: 392,015

[22] Filed: Aug. 10, 1989

[51] Int. Cl.[5] ..... E04B 1/38

[52] U.S. Cl. ..... 52/712; 52/92; 52/105; 52/702

[58] Field of Search ..... 52/92, 105, 712, 702

[56] References Cited

U.S. PATENT DOCUMENTS

| | | | |
|---|---|---|---|
| 3,365,222 | 1/1968 | Polyak | 52/712 X |
| 4,410,294 | 10/1983 | Gilb et al. | 52/102 X |
| 4,620,403 | 11/1986 | Field | 52/480 |
| 4,635,424 | 1/1987 | Drapeau | 52/480 |
| 4,669,235 | 6/1987 | Reinen | 52/92 X |

FOREIGN PATENT DOCUMENTS 1572865 8/1980 United Kingdom .

*Primary Examiner*—David A. Scherbel
*Assistant Examiner*—Linda Jean Hoffert
*Attorney, Agent, or Firm*—Calif K. Tervo

[57] ABSTRACT

An anchoring bracket for use in attaching substantially parallel boards to a generally transverse member or joist and in spacing the boards generally comprises a rain-spacer side and a joist attachment side. The rain spacer side has a spacing portion for placement on the top of the joist for spacing a board from the joist and an extended portion attached to the spacing portion for extending over the edge of the joist. A board spacer tab, affixed to the rain-spacer side, projects generally perpendicularly upward therefrom for positioning directly adjacent a board for controlling the spacing thereof. The joist attachment side includes an attachment portion disposed generally perpendicular to the rain-spacer side for attachment to the side of the joist and an angled portion connecting the attachment portion to the outer end of the extended portion. The angled portion includes holes for receiving a fastener for fastening a board to the bracket. An alternate embodiment includes a plurality of board spacer tabs affixed at intervals to the rain-spacer side; each for positioning directly adjacent a board for controlling the spacing of a plurality of boards.

9 Claims, 1 Drawing Sheet

DECK BRACKET

BACKGROUND OF THE INVENTION

1. Field of the Invention

This invention pertains to fastening brackets and more specifically involves a bracket for spacing and fastening deck boards to a joist from the bottom.

2. Background Art

Wooden decks or fences comprising two or more wooden joists spanned by a plurality of parallel boards nailed to the joists are typically constructed by driving nails down through the exposed face surface of the boards into the joists. This method is undesirable for several reasons. With hammering, it is easy to miss and hit the board thus denting or marring it. Box head nail hold well but can be seen and detract from the aesthetic appearance of the deck. The nail head will often discolor the area around it. Finish nails aren't as displeasing in appearance but take longer to install and retain water in the hole which leads to rot and rust. Nails can work up such that the nail head is above the board surface and cause a safety hazard. Water gets into the crack between the board and joist and causes rot.

One alternative which produces a more aesthetic surface is to drill countersink as screw and to plug the hole above the screw with a bit of wood. This method is expensive and time consuming; the plugs work out in time, and the holes fill with water.

Therefore, it is desirable to have an attachment device which overcomes the shortcomings of the prior art; which attaches boards to a deck with an unmarred upper surface especially if it spaces the boards from the joist.

It is further desirable that the attachment device provide a means for spacing the boards from one another.

SUMMARY OF THE INVENTION

According to the invention, an anchoring bracket for use in attaching substantially parallel boards to a generally transverse member or joist and in spacing the boards generally comprises a rain-spacer side and a joist attachment side. The rain spacer side has a spacing portion for placement on the top of the joist for spacing a board from the joist and an extended portion attached to the spacing portion for extending over the edge of the joist. A board spacer tab, affixed to the rain-spacer side, projects generally perpendicularly upward therefrom for positioning directly adjacent a board for controlling the spacing thereof. The joist attachment side includes an attachment portion disposed generally perpendicular to the rain-spacer side for attachment to the side of the joist and an angled portion connecting the attachment portion to the outer end of the extended portion. The Angled portion includes holes for receiving a fastener for fastening a board to the bracket.

An alternate embodiment includes a plurality of board spacer tabs affixed at intervals to the rain-spacer side; each for positioning directly adjacent a board for controlling the spacing of a plurality of boards.

Other features and many attendant advantages of the invention will become more apparent upon a reading of the following detailed description together with the drawings, wherein like reference numerals refer to like parts throughout.

DETAILED DESCRIPTION OF THE INVENTION

Figure 1:
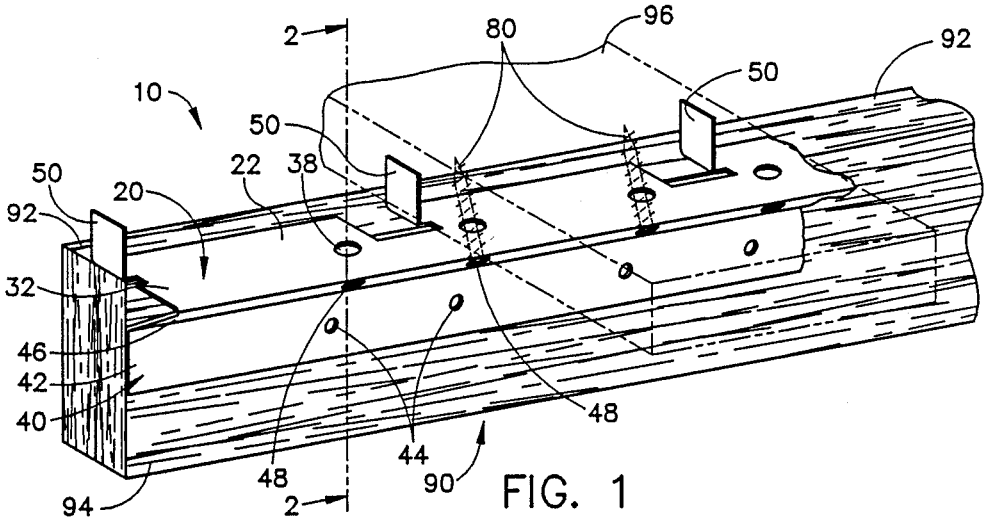
FIG. 1 is a perspective view illustrating a preferred embodiment of the deck bracket of the present invention.

With reference now to the drawing, and more particularly to FIG. 1 thereof, there is shown in perspective view a typical wooden joist, denoted generally as 90, which is used to support a plurality of parallel boards 96, of which one is shown. Boards 96 span transversely between two or more joists 90 to form a flat surface, such as a deck or fence. Joist 90 has a top surface 92 for supporting boards 96 and a side surface 94 that is generally perpendicular to top surface 92.

Placed onto joist 90, is a preferred embodiment of the deck anchor bracket, denoted generally as 10. Deck bracket 10 is typically constructed of a single sheet of metal, such as stainless steel of 0.024 inches thick or aluminum of 0.040 inches thick, which is bent into the illustrated configuration. Other materials, such as composite or plastic, having the necessary strength and weather resistance could be used, and the thickness can vary considerably and still function; although thinner material is generally preferred for lower cost.

Bracket 10 includes a rain-spacer side, denoted generally as 20, and a joist attachment side, denoted generally as 40. Rain-spacer side 20 is placed on the top surface 92 of joist 90 and includes a spacing portion 22 that actually lies on top surface 92 and an extended portion 32 that extends out past the edge of the joist 90.

A series of board spacer tabs 50, affixed to rain-spacer side 20, project perpendicularly upward. In the preferred embodiment illustrated, tabs 50 are shown to be bent up from the same piece of sheet stock as the remainder of the bracket 10. However, they may be of different stock and may be attached in any of several manners, such as by welding. Preferably, tabs 50 are spaced exactly a board width apart. Thus, the deck boards can be positioned and will be immediately held in position with proper spacing for fastening and drainage. If tabs 50 are more widely spaced, then justifying all boards one direction results in uniform parallel spacing of the boards 96. For example, with deck boards of 5.5 inch width a spacing of 5.531 inches between tabs 50 presents a pleasing appearance which drains well. For standard one and one-half inch thick deck boards, tabs 50 of one-half inch in height have been found sufficient. Shorter tabs may be used on thinner boards so that the top of the tab does not protrude above the upper surface of the board 96.

The joist attachment side 40 of bracket 10 includes an attachment portion 42 and an angled portion 46. Attachment portion 42 is generally perpendicular to rain-spacer side 20 for attachment to side 94 of joist 90. Attachment portion 42 includes means, such as attachment holes 44, for accepting fasteners for facilitating attachment to joist side 94. Fasteners, such as nails or screws, may be used. Nails are preferable as they are stronger in shear and it is primarily shear forces exerted on this junction. Attachment holes 44 are spaced preferably in line with fastener holes 48, yet to be described, with additional holes 44 as desired for convenience of fabrication.

Angled portion 46 connects the top of attachment portion 42 with the outer end of extended portion 32. Preferably, the interior angle between angled portion 46 and extended portion 32 is approximately forty five degrees. Board fastener receiving means, such as fastener holes 48, in angled portion 46 are aligned with complementary holes 38 in extended portion 32 to accommodate a fastener, such as wood screw 80 shown in phantom, for attaching board 96 to bracket 10. In the preferred embodiment, board fastener holes 48 are countersunk. Preferably, board fastener holes 48 and complementary holes 38 are aligned at a forty five degree angle. This angle best facilitates use of a power screw driver in the ninety degree angle space between joist 90 and board 96. Also, the angled fastening screws, being resistant to both sheer and tension, securely retain the boards.

Figure 2:
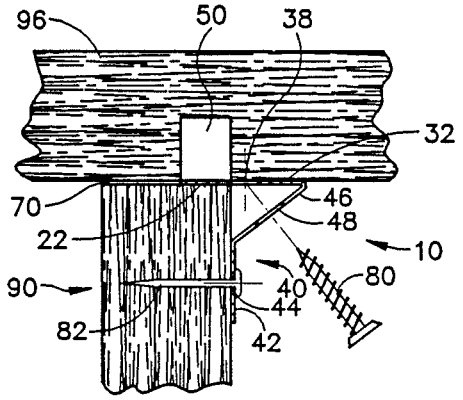
FIG. 2 is an enlarged end elevation view taken along line 2—2 of FIG. 1.

Turning now to FIG. 2, there is illustrated a slightly enlarged end view taken along line 2—2 of FIG. 1. It can be seen that rain-spacer side 20 of bracket 10 creates a space 70 between joist 90 and board 96. This space 70 allows air to circulate and dry between joist 90 and board 96 thereby preventing rot.

Figure 3:
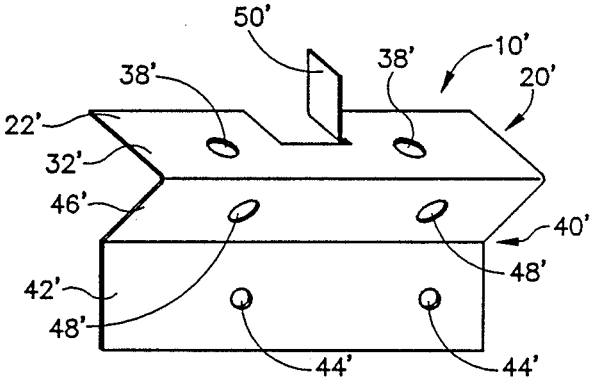
FIG. 3 is a perspective view of an alternative embodiment of the deck bracket; this having only one board spacing tab.

In FIG. 3 an alternate preferred embodiment of the deck bracket, single tab bracket 10', is shown. Bracket 10' is similar to bracket 10 and includes rain-spacer side 20' having spacing portion 22' and extended portion 32' and joist attachment side 40' having angled portion 46' and attachment portion 42' with attachment holes 44'. Board fastener receiving holes 48' and complementary holes 38' are aligned in pairs for receiving a screw fastener. Bracket 10' is bent from a single piece of sheet stock includes a single tab 50' that is bent up out of the sheet. Single tab bracket 10' may be used in spaces too short for multiple tab bracket 10 instead of cutting down a multiple tab bracket 10. Or a multiplicity of single tab brackets 10' may be used to replace a multiple tab bracket 10.

In use, bracket 10 is placed in position on joist 90 as shown in FIG. 1 with the spacing portion 22 atop the joist 90. Then attachment portion 42 is nailed to joist side 94. The deck boards 96 may be attached one at a time whereby a deck board 96 is placed into position atop spacing portion 22 and held against tab 50 while secured with screws 80. This procedure allows the installer to work from the side. Alternatively, if there is ample room for the installer to work under the deck, there is a saving in labor if all of the deck boards 96 are laid in position at the same time and are then secured from the bottom.

Single tab bracket 10' is similarly used except that subsequent brackets 10' are first positioned by appropriately measuring the distance between tabs 50' before attaching the bracket 10' to the joist 90.

A deck constructed incorporating the invention has no fasteners driven through the top face of the boards and no fastener heads are exposed to view. Hammer marring of the boards is avoided. The top deck surface is free of holes or damage and the deck's appearance is thereby enhanced. Deck boards 96 are spaced apart to allow water run off and air flow. Deck boards 96 are separated from joists 90 which prevents rot.

Use of bracket 10 speeds construction and reduces the degree of construction skill required by the installer because uniform spacing is provided by tabs 50 and the conventional steps of measuring the spacing between adjacent boards and carefully aligning each board are eliminated.

Although particular embodiments of the invention have been illustrated and described, various changes and modifications can be made in the form, construction, and arrangement of the parts without sacrificing any of the advantages, and it is to be understood that all matter herein is to be interpreted as illustrative and not in any limiting sense, and it is intended to cover in the appended claims such modifications and changes as come within the true spirit and scope of the invention.

I claim:

1. An anchoring bracket for use in a attaching a series of substantially parallel boards to a generally transversely oriented member, such as a joist, having a top surface for receiving the boards and having a side surface substantially perpendicular thereto; said bracket comprising:

a rain-spacer side having:

a spacing portion for placement on the top of the joist for spacing a board from the joist; and an extended portion attached to said spacing portion for extending outward past the edge of the joist; said extended portion having an outer end; and a joist attachment side including:

an attachment portion disposed generally perpendicular to said rain spacer-side for attachment to the side of the joist underlying said extended portion of said rain spacer side; and an angled portion connected to said attachment portion and to said outer end of said extended portion and including a hole therethrough for receiving a fastener for fastening a board lying on said spacing portion atop a joist to said bracket.

2. The anchoring bracket of claim 1 including:

a board spacer tab affixed to said rain-spacer side and projecting generally perpendicularly upward therefrom for positioning directly adjacent a board for controlling the spacing thereof.

3. The anchoring device of claim 1 wherein said extended portion includes a hole therethrough in alignment with the hole in said angled portion for passage of a fastener through both said portions.

4. An anchoring bracket for use in attaching a series of substantially parallel boards to a generally transversely oriented member, such as a joist, having a top surface for receiving he boards and having a side surface substantially perpendicular thereto, and for spacing the boards; said bracket comprising:

a rain-spacer side having:

a spacing portion for placement on the top of the joist for spacing the boards from the joist; and an extended portion attached to said spacing portion for extending outward past the edge of the joist; said extended portion having an outer end;

a plurality of board spacer tabs affixed at intervals to said rain-spacer side and projecting generally perpendicularly upward therefrom; each for positioning directly adjacent a board for controlling the spacing of a plurality of boards; and a joist attachment side including:

an attachment portion disposed generally perpendicular to said rain spacer side for attachment to the side of the joist underlying said extended portion; and an angled portion connected to said attachment portion and to said outer end of said extended portion and including a plurality of holes therethrough for receiving fasteners for fastening the boards to said bracket.

5. The anchoring device of claim 4 wherein said extended portion includes a hole therethrough in alignment with each said hole in said angled portion for passage of a fasteners through both said portions.

6. A method of attaching a series of substantially parallel boards to a generally transversely oriented member, such as a joist, having a top surface for receiving the boards and having a side surface substantially perpendicular thereto, and for spacing the parallel boards from one another; said method comprising the steps of:

placing a series of anchoring brackets in position on the joist; each anchoring bracket comprising:

a rain-spacer side having:

a spacing portion for placement on the top of the joist for spacing the boards from the joist; and an extended portion attached to said spacing portion for extending outward past the edge of the joist; said extended portion having an outer end;

a board spacer tab affixed to said rain-spacer side and projecting generally perpendicularly upward therefrom for positioning directly adjacent a board for controlling the spacing thereof; and a joist attachment side including:

an attachment portion disposed generally perpendicular to said rain spacer-side for attachment to the side of the joist underlying said extended portion; and an angled portion connected to said attachment portion and to said outer end of said extended portion and including at least one hole for receiving a fastener for fastening a board to said bracket;

attaching the attachment portion of the anchoring brackets to the side of the joist such that the tabs are at selected spacing;

placing a board on top of the spacing portion of each attached bracket and adjacent a tab;

fastening each placed board to the anchoring bracket by means of a fastener in an angled portion hole.

7. A method of attaching a board to a generally transversely oriented member, such as a joist, having a top surface for receiving the board and having a side surface substantially perpendicular thereto; said method comprising the steps of:

placing an anchoring bracket in position on the joist; the anchoring bracket comprising:

a rain-spacer side having:

a spacing portion for placement on the top of the joist for spacing the board from the joist; and an extended portion attached to said spacing portion for extending outward past the edge of the joist; said extended portion terminating in an outer end; and a joist attachment side including:

an attachment portion disposed generally perpendicular to said rain spacer side for attachment to the side of the joist underlying said extended portion; and an angled portion connected to said attachment portion and to said outer end of said extended portion and including at least one hole for receiving a fastener for fastening a board to said bracket;

attaching the attachment portion of the anchoring bracket to the side of the joist;

placing a board on top of the spacing portion;

fastening the board to the anchoring bracket by using a fastener in a hole in said angled portion.

8. The method of claim 7 wherein said anchoring bracket includes a plurality of board spacer tabs affixed at intervals to said rain-spacer side and projecting generally perpendicularly upward therefrom; each for positioning directly adjacent a board for controlling the spacing of a plurality of boards; and further including the step of adjusting the spacing between placed boards by placing each board adjacent a tab.

9. An anchoring bracket for use in attaching a board to a generally transversely oriented member, such as a joist, having a top surface for receiving the board and having a side surface substantially perpendicular thereto; said bracket comprising:

a rain-spacer side having:

a spacing portion for placement on the top of the joist for spacing a board from the joist; and an extended portion attached to said spacing portion for extending outward past the edge of the joist; said extended portion having an outer end; and a joist attachment side including:

an attachment portion disposed generally perpendicular to said rain spacer-side for attachment to the side of the joist underlying said extended portion of said rain spacer side; and an angled portion connected to said attachment portion and to said outer end of said extended portion and including a hole therethrough for receiving a fastener for fastening a board lying on said spacing portion atop a joist to said bracket.

* * * * *